US005607623A

United States Patent [19]

Benton et al.

[11] Patent Number: 5,607,623

[45] Date of Patent: Mar. 4, 1997

[54] INHIBITION OF CARBON DIOXIDE CORROSION OF METALS

[75] Inventors: William J. Benton, Magnolia, Tex.; Larry P. Koskan, Orland Park, Ill.

[73] Assignee: Donlar Corporation, Bedford Park, Ill.

[21] Appl. No.: 400,369

[22] Filed: Mar. 8, 1995

[51] Int. Cl.[6] ..... C23F 11/14; C23F 11/173

[52] U.S. Cl. ..... 252/392; 252/389.61; 252/389.62; 507/939; 422/16

[58] Field of Search ..... 252/390, 392, 252/389.61, 389.62; 422/16; 507/939

[56] References Cited

U.S. PATENT DOCUMENTS

| | | | |
|---|---|---|---|
| 4,971,724 | 11/1990 | Kalota et al. | 252/390 |
| 5,116,513 | 5/1992 | Koskan et al. | 210/698 |
| 5,152,902 | 10/1992 | Koskan et al. | 210/698 |
| 5,221,733 | 6/1993 | Koskan et al. | 530/333 |
| 5,284,512 | 2/1994 | Koskan et al. | 106/416 |
| 5,300,235 | 4/1994 | Clewlow et al. | 252/8.555 |
| 5,315,010 | 5/1994 | Koskan et al. | 548/520 |
| 5,373,086 | 12/1994 | Koskan et al. | 528/328 |
| 5,391,764 | 2/1995 | Koskan et al. | 548/520 |
| 5,443,651 | 8/1995 | Kalota et al. | 134/2 |
| 5,457,176 | 10/1995 | Adler et al. | 510/230 |
| 5,478,919 | 12/1995 | Koskan et al. | 528/363 |

OTHER PUBLICATIONS

Uhlig, Herbert H. *The Corrosion Handbook,* N.Y., John Wiley & Sons Inc., 1948, p. 1118.

Silverman, D. C. "Effect of pH on Corrosion Inhibition of Steel, " *Corrosion* (Houston), vol. 51, No. 11 (1995, Jan.) pp. 88–825 as Abstracted by Chemical Abstract 1995:912824.

EP654514 A–1 Sep. 24, 1995 as Abstracted by Chem. Ab. 1995:846542.

JP04214777AZ Aug. 5, 1992 As Abstracted by Chem. Ab. 118:104997.

WO 9112354 Aug. 22, 1991 as Abstracted by Chemical Ab. 1991:684617.

Little et al. *ACS Symp. Ser. (Jan. 1991), 444 (Surf. React. Pept. Polym.: Discovery Commer.)* 263–79, "Corrosion Inhibition by Thermal Polyaspartate." As Abstracted by Chem Ab. 1991:90645.

Little, B.J. & Sikes, C. S., Corrosion Inhibition by Thermal Polyaspartate, In: *Surface Reactive Peptides and Polymers: Discovery and Commercialization,* C.S. Sikes and A.P. Wheeler, eds., ACS Books, 1991.

Mueller, E. & C.S. Sikes, Polypeptide Inhibitors of Steel Corrosion in Sea Water, *Corrosion/91,* Paper No. 274, NACE International, Houston, TX, 1991.

White, C.W., et al., A Case History for Corrosion Inhibitor Selection for the Forties Export Pipeline, *Corrosion Science,* 35: 1515–1525, 1993.

*Primary Examiner*—Shean C. Wo
*Assistant Examiner*—Valerie Fee
*Attorney, Agent, or Firm*—Olson & Hierl, Ltd.

[57] ABSTRACT

Polyaspartic acid and its salts ms used as a carbon dioxide corrosion inhibitor for ferrous metal surfaces in contact with a substantially acidic corrosive aqueous saline environment. In particular, carbon dioxide corrosion of mild steel in brine substantially free of dissolved oxygen can be effectively inhibited under mild to moderate dynamic flow use conditions by relatively low concentrations of polyaspartic acid.

7 Claims, 11 Drawing Sheets

INHIBITION OF CARBON DIOXIDE CORROSION OF METALS

FIELD OF THE INVENTION

This invention relates to the use of polyaspartic acid and salts thereof to inhibit carbon dioxide corrosion of ferrous metals in the presence of an otherwise corrosive aqueous saline environment.

BACKGROUND OF THE INVENTION

Corrosion of metal and mineral scale formation are common problems in a variety of industrial settings, especially in oilfield and water treatment systems. In corrosion, a chemical or electrochemical reaction between a material, usually a metal, and its environment produces a deterioration of the material and its properties. This corrosive attack can be uniform or localized over the metal surface but generally results in undesirably shortening the useful life or utility of the metal surface.

An example of chemical attack is the air oxidation of hot steel which forms an iron oxide coating. In order to have electrochemical corrosion, it is necessary to have an (1) anode; (2) cathode; (3) electrolyte and (4) external connection.

The presence of water is essential to low temperature corrosion processes. However, pure water containing no dissolved substances is only very mildly corrosive to iron. Water containing impurities or dissolved substances can be corrosive or noncorrosive, depending on the nature of the dissolved substances. Chromates and phosphates are dissolved in water to inhibit or reduce corrosion. Other substances such as salts, acids, hydrogen sulfide, carbon dioxide, and oxygen can increase the corrosivity of the water. Generally, the water encountered in oilfield operations, in particular, contains one or more of these substances which increase its corrosivity.

Dissolved carbon dioxide further influences the solubility of magnesium and calcium carbonates. These salts sometimes precipitate on the surface of a metal pipe and form a protective coating. However, water containing "aggressive" carbon dioxide (i.e., excess carbon dioxide dissolved in water) will not deposit this protective coating. Salts dissolved in the water may act as buffers, thereby preventing the pH from reaching a low enough value to produce serious corrosion.

In addition to the impurities which are commonly found in water, temperature and velocity also influence the corrosivity of water. Seldom is a corrosion problem encountered where only one of these contributing factors is present. Consequently, the problem is complex because of these various influences and the manner in which they may interact with each other. Thus, the art continues to need new and improved methods of inhibiting metal corrosion in various aqueous environments utilizing environmentally acceptable chemistries.

In certain industries, economics often determine what metal materials of construction are selected for equipment associated with that industry. The North Sea and Alaskan oil and gas production fields are typical commercial examples. For example, mild steel is generally the metal of choice for equipment and long pipelines. Oil field waters, such as brine and formation water, present in mild steel pipes provide a corrosive environment which can cause electrochemical corrosion to occur at the solid-liquid interface. In this corrosive environment, carbon dioxide is dissolved in a brackish to brine aqueous solution with associated hydrocarbons from the production of the oil or gas but it will generally not contain dissolved oxygen. Consequently, chemical corrosion seldom occurs but electrochemical corrosion occurs at solid-liquid interfaces in nearly every instance where oilfield water contact steel equipment.

The need for a specialized corrosion inhibition is known to persons in the field of controlling the internal corrosion of mild steel surfaces associated with oil and gas production and their transportation. Protecting metal surfaces against corrosive deterioration is currently achieved through the use of multi-component corrosion inhibitor systems, which are nitrogen and aromatic compounds, such as amine and organic sulfide containing compositions. These combination corrosion inhibitors, therefore, raise environmental concerns due to their persistence or hazardous nature and biota impact on the surrounding environment and public health.

Heavy metals, chromates, phosphates, silicates and persistent film-forming materials are typical inhibitors for minimizing corrosion of iron and steel in aqueous solutions. These inhibitors all have a negative environmental impact, such as, toxicity, eutrophication and environmental persistence. Moreover the removal of these materials from the environment requires complicated and expensive processes.

There is a desire and need, therefore, for environmentally friendly (biodegradable) chemistries which provide equal or better carbon dioxide corrosion inhibition in otherwise corrosive aqueous saline environments than presently available inhibitors.

The search for environmentally acceptable carbon dioxide corrosion inhibitors for metal surfaces in contact with aqueous saline environments is well known to those skilled in the art of aqueous corrosion inhibition.

Polyaspartic acid and its salts have previously been shown to inhibit scale formation and possess dispersancy properties for calcium carbonate and phosphate in U.S. Pat. No. 5,152,902 to Koskan et al., and of calcium sulfate and barium sulfate in U.S. Pat. No. 5,116,513 to Koskan et al. These characteristics make polyaspartic acid and its salts desirably compatible with the deposit control chemistries utilized in the oil and gas production industries.

Amino acids, and notably aspartic acid, have generally been found to have little tendency toward effective corrosion inhibition for commercial use. Moreover, aspartic acid is known to be inherently corrosive at slightly alkaline pH conditions, reportedly actually accelerating corrosion at a pH of about 8. Therefore, amino acids, such as aspartic acid, although possessing desirable non-toxic biodegradable properties, generally have been avoided as corrosion inhibitors.

Researchers have reported that thermally produced polyaspartate, a synthetic polypeptide consisting of approximately 20 aspartic acid residues (apparent molecular weight of about 2000 to about 5000) was a mild inhibitor of the corrosion of mild steel coupons exposed to synthetic seawater at pH 8 under static use conditions. However, the maximum inhibition achieved reportedly was less than 30%. See, Little, et al., "Corrosion Inhibition by Polyaspartate," *Surface Reactive Peptides and Polymers: Discovery and Commercialization,* Sikes and Wheeler (Eds), ACS Symposium Series No. 444(1990); and Mueller et al., "Polypeptide Inhibitors of Steel Corrosion in Sea Water," Paper 274 presented at the NACE Annual Conference and Corrosion Show (1991).

U.S. Pat. No. 4,971,724 to Kalota et al., teaches that aspartic acid and polyaspartic acid demonstrate corrosion inhibiting properties on mild steel coupons in aerated, carbon dioxide-free deionized water under static use conditions providing they are fully ionized at above pH 8.9. However, pitting corrosion remained a concern until above pH 10.

Surprisingly, polyaspartic acid has now been found useful as a carbon dioxide corrosion inhibitor of ferrous metals in an aqueous saline environment that is substantially free of dissolved oxygen.

SUMMARY OF THE INVENTION

Polyaspartic acid has been found effective in inhibiting carbon dioxide corrosion of ferrous metals in an aqueous saline environment having a substantially acidic pH. The term "polyaspartic acid" as used herein includes the salts of polyaspartic acid.

In particular, polyaspartic acid was found to effectively inhibit the carbon dioxide corrosion of mild steel in contact with brine which is substantially free of dissolved oxygen and has a pH in a range of about pH 4 and below about pH 7. Surprisingly, this carbon dioxide corrosion inhibition can be practiced with a relatively low amount of polyaspartic acid of about 10 parts per million (ppm) based on the volume of aqueous saline environment contacting the surface of the ferrous metal, under mild to moderate dynamic flow use conditions.

Polyaspartic acid prepared by any method can be used. A preferred polyaspartic acid has a weight average molecular weight (Mw) in the range of about 1,000 and about 10,000. Particularly preferred is β-polyaspartic acid (i.e., one having greater than 50% β-form and less than 50% of α-form) prepared as described in U.S. Pat. No. 5,284,512 to Koskan et al.

Beneficial advantages of using polyaspartic acid as a corrosion inhibitor over currently commercially available inhibitors are its environmentally friendly, biodegradable nature. In the oil and gas production industries, in particular, the beneficial compatibility of polyaspartic acid with their deposit control chemistry requirements further enhances its commercial importance and value in these applications. Other and further features, advantages and the like will be apparent to those skilled in the art from the present specification and the appended claims.

DESCRIPTION OF THE INVENTION

Figure 1:
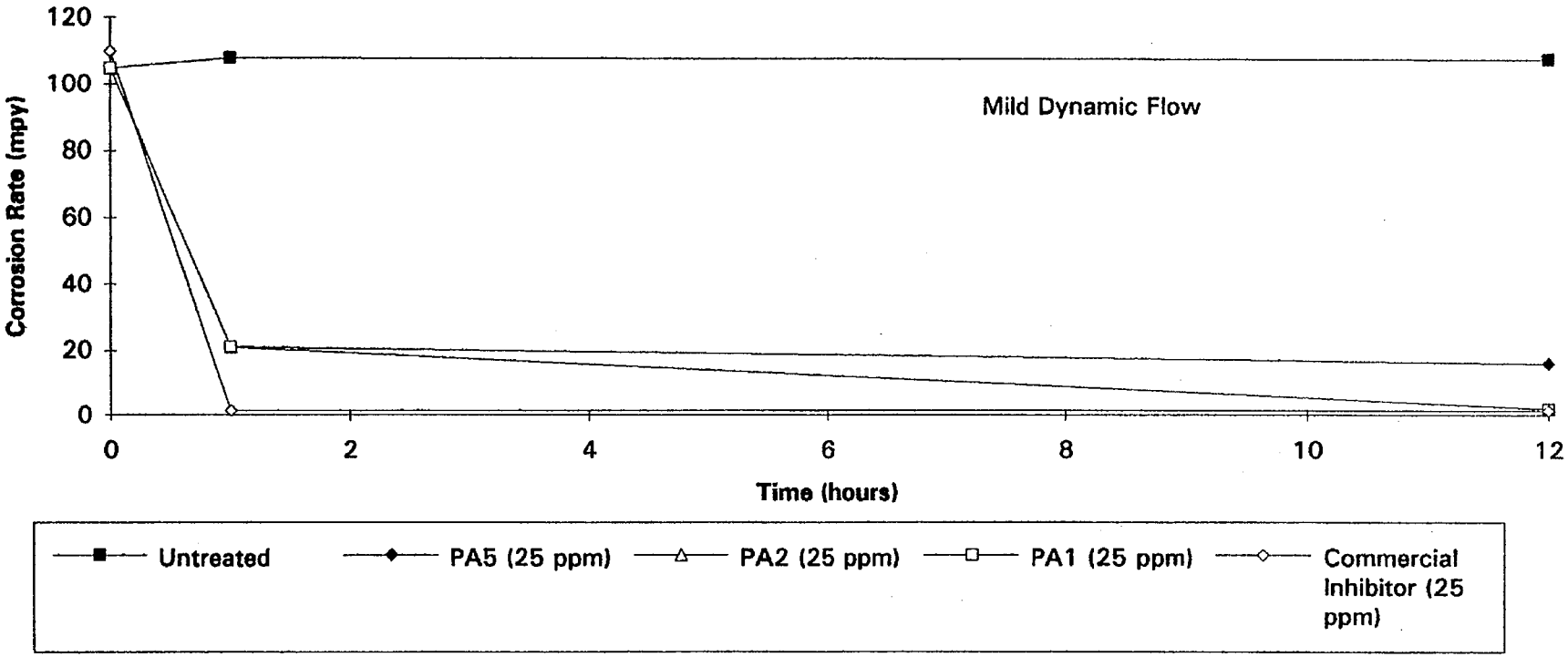
FIG. 1 graphically compares the effectiveness of carbon dioxide corrosion inhibition by polyaspartic acid ranging in weight average molecular weight from about 1000 to about 5000 relative to that of a reference commercial inhibitor plotted as a function of time under simulated mild dynamic flow use conditions.

The term "aqueous saline environment" is used herein for convenience to include brackish to brine water, sea water and aqueous solutions which contain sufficient dissolved carbon dioxide salts and electrolytes to corrode metal surfaces in contact therewith, and ferrous metal in particular. The term "ferrous metals" is used for convenience to include iron, steel and like iron metals which are susceptible to corrosion by oxidation from iron to ferrous ion.

Briefly described, in the practice of this invention polyaspartic acid is added to an aqueous saline environment which is normally corrosive to mild steel which is susceptible to carbon dioxide corrosion.

Polyaspartic acid is a copolymer containing two forms of L-aspartic acid. The alpha (α-) form is acetoacetamide. The beta (β-) form is 3-carboxypropionamide. Analysis of polyaspartic acids by Nuclear Magnetic Resource (NMR) indicated that the polyaspartic acids utilized for illustrating this invention have greater than about 50% β-form and less than 50% α-form.

Preferred polyaspartic acids are about 65% to about 80% β-form and about 35% to about 20% α-form. More preferably, polyaspartic acid is about 70% to about 80% β-form and most preferably about 70% to about 75% β-form. Preferably, polyaspartic acid has a weight average molecular weight (Mw) in the range of about 1000 to about 10,000.

Polyaspartic acid prepared from any known process can be used to practice the corrosion inhibition processes described. A preferred polyaspartic acid utilized in this invention was prepared from hydrolyzed polysuccinimide. Polyaspartic acid can also be in a water-soluble salt form having a counterion selected from the group consisting of alkali metals, alkaline earth metals, ammonium and quaternary alkyl amino groups having 1 to about 4 carbon atoms in each alkyl moiety thereof. Gel Permeation Chromatography (GPC) was utilized to determine the molecular weight of the polyaspartic acid. This technique is known in the art and a description of the procedure can found in U.S. Pat. No. 5,152,902, the disclosures of which are incorporated herein by reference. Briefly described, the molecular weights were determined utilizing polyacrylic acid (Rohm & Haas) reference standards having molecular weights of 2000 and 4500. Since molecular weights based on GPC can vary with the standards used, they are reported as weight average molecular weight (Mw). Thus, the polyaspartic acids utilized in illustrating this invention were within the range of about 1000 Mw to about 10,000 Mw.

For purposes of illustrating the beneficial effectiveness of polyaspartic acid as a carbon dioxide inhibitor, the corrosive aqueous saline environment free of dissolved oxygen typically present in oilfield water was simulated and utilized.

In the field, the corrosivity of ferrous metals can be impacted by the brine composition, crude oil/gas type, ratio of water phase to hydrocarbon phase and fluid flow shear in the pipeline. Carbon dioxide and hydrogen sulfide gases also impact the type and amount of corrosion possible in this environment.

Thus, internal corrosion of oil and gas pipelines by the transported fluid is complex and difficult to simulate in the laboratory. Absolute simulation of field conditions in a single laboratory testing technique is not realistically possible. Laboratory testing has not been able to exactly duplicate every aspect of field operating conditions. Typically, laboratory corrosion tests attempt to simulate the most important conditions, such as chemistry and temperature, by utilizing either a "bubble test" or a "recirculating flow loop" test, both of which are known to those persons skilled in the art.

A description of the methods and apparatus utilized for the bubble test can be found in the literature. See, for example, Webster et al., "Corrosion Inhibition Selection for Oilfield Pipelines," Corrosion/93, Paper No. 109, NACE International Conference, Houston, Tex. (1993), the pertinent disclosures of which are incorporated herein by reference. A description of the methods and apparatus utilized for a small recirculating flow loop of about 3 liters (L) capacity also can be found in the literature. See, for example, White et al., "A Case History for Corrosion Inhibitor Selection for the Forties Export Pipeline," *Corrosion Science,* 35, Nos. 5–8, 1515–1525 (1993).

The "bubble test" is a relatively simple, substantially low shear sparged beaker test cell which can be set up reasonably quickly. It is ideal for rapidly carrying out a large number of tests such as, for example, in the first stage of corrosion inhibitor selection, or for screening a wide range of field conditions. A gantry of several test cells connected to an automated corrosion rate measuring system can also be used for convenience.

Briefly described, a useful bubble test cell is a sealable beaker adapted (1) for introducing test liquid, (2) for introducing a corrosion test probe into the liquid, (3) for sparging carbon dioxide to maintain a counter-current of carbon dioxide to prevent air ingress during the insertion of the test probe and to substantially strip out dissolved oxygen, preferably to less than about 10 parts per billion (ppb) and (4) with a stirrer to produce a relatively low wall stress shear to simulate substantially mild dynamic flow use conditions. For convenience, the results obtained from bubble tests will be referred to herein as "mild dynamic flow use conditions."

A useful corrosion test probe is a standard 2 or 3 element linear polarization resistance (LPR) corrosion probe. The elements are preferably mild steel.

The electrochemical technique of polarization resistance is used to measure absolute corrosion rates, and is also usually expressed in milli-inches (mils) per year (mpy). Polarization resistance measurements can be made very rapidly, usually in less than about ten minutes. Excellent correlation can often be made between corrosion rates obtained by polarization resistance and conventional weight-loss determinations. Polarization resistance is also referred to as "linear polarization". A detailed discussion and description of electrochemical corrosion theory and polarization resistance can be found in the literature. See, for example, *Application Note Corr* 1: *Basics of Corrosion Measurements,* published by The Analytical Instrument Division of EG&G Princeton Applied Research (1980).

A useful stirrer for a test cell beaker having a volume of at least about 140 cubic centimeter ($cm^3$) can be a magnetic stirrer bar of about 3.5 centimeter (cm) length which, when rotating at about 300 revolutions per minute (rpm), produces a shear rate at the outside edge of about 1.2 Pascals (Pa), and likely less than that at the electrode. In a typical export pipeline, such as in commercial oilfields the average wall shear stress is about 3 Pa to about 8 Pa. Thus, the main limitation of the bubble test is that the shear stresses in the stirred test liquid are significantly less than those experienced in a pipeline.

Laboratory corrosion testing utilizing a recirculating flow loop simulates the substantially medium to high shear turbulent flow regimes present in equipment and pipelines. Increasing shear stress can have a significant adverse effect on the performance of certain corrosion inhibitors. For example, at about 7 Pa shear stress, the absorption of an inhibitor can became negligible. Additionally, shear stress can adversely affect the persistency of an inhibitor film on a steel surface.

A laboratory recirculating flow loop apparatus, however, can simulate turbulent flow regimes similar to those in the field from a pressure of 4 bar up to about 100 bar by respectively changing the material of construction from glass to metal. The shear stress achievable is dependent on geometry and flow rate but typically is similar to that experienced in pipelines up to about 20 Pa.

Briefly described, the major units of a useful recirculating flow loop can consist of (1) one or more reservoirs where the test liquid can be conditioned before starting the test, (2) a centrifugal pump with a flow rate control valve, (3) a means for heating or cooling the test liquid and (4) a cell to hold the test electrodes. The test liquid can be pumped either around a by-pass to aid in deaeration and conditioning or be diverted through the test cell for corrosion measurement. For convenience the results obtained from recirculating flow loop tests producing a substantially medium wall shear stress of about are referred to herein as "moderate dynamic flow use conditions."

A useful test cell can be constructed from nylon (for a low pressure loop) or of metal for a high pressure loop). The test electrodes preferably comprise three identical test specimens machined from pipeline grade steel or mild steel to simulate pipe wall conditions. This enables corrosion rate behaviors to be determined by conventional electrochemical measurements, such as linear polar resistance (LPR) probe, AC impedance and full polarization.

The effectiveness of polyaspartic acid as a carbon dioxide corrosion inhibitor in accordance with the present invention was determined under simulated substantially mild dynamic flow use conditions using the bubble test and under simulated moderate dynamic flow use conditions using a 3 liter capacity recirculating glass flow loop and a flow velocity of about 1.6 meters/second (m/s) to simulate a wall shear stress of about 7 Pa.

For convenience, the test liquid utilized to illustrate the effectiveness of polyaspartic acid as a carbon dioxide corrosion inhibitor was artificial brine of high ionic strength. The artificial brine had the salt content in grams per liter set forth in Table I, below.

TABLE I

ARTIFICIAL AQUEOUS BRINE

| Salt | Conc. (g/l) |
|---|---|
| $Na_2SO_4$ | 0.016 |
| NaCl | 74.14 |
| $NaHCO_3$ | 0.68 |
| $MgCl_26H_2O$ | 4.21 |
| $CaCl_26H_2O$ | 17.19 |
| KCl | 0.71 |
| Deionized water to 1 Liter | |

The artificial brine is preferably prepared by dissolving all of the chloride salts first. The solution is then preferably saturated with carbon dioxide followed by the addition of the bicarbonate and the sulphate salts previously dissolved in small quantities of water. This method of preparation minimizes the amount of scale precipitation.

The artificial aqueous brine prepared as described hereinabove simulates the composition of North Sea brine, such as present in the Forties export pipeline system. Forties brine is known to contain about 2800 ppm calcium ion ($Ca^{++}$), about 496 ppm $NaHCO_3$ and have a natural pH of about 5.6.

All of the corrosion inhibition tests were carried out on ferrous metals, preferably mild (C1008) steel under simulated field and operating temperature use conditions of from about ambient room temperature to about 150° C., preferably at about 25° C. to greater than about 80° C. and more preferably at about 50° C. The test solutions were fully deaerated with nitrogen and then saturated with carbon dioxide, at a pressure of about 1 bar (absolute) to give a pH of about 5.6.

An effective corrosion inhibiting amount of polyaspartic acid can be at least about 10 ppm to about 5000 ppm as polyaspartic acid, preferably at least about 25 ppm to about 500 ppm polyaspartic acid, based on the volume of liquid aqueous saline environment. Polyaspartic acid effectively inhibited carbon dioxide corrosion of mild steel in brine, substantially free of dissolved oxygen, at a substantially acid pH range of about pH 4 to less than about pH 7, preferably in the range of about pH 4 to about pH 6.6, more preferably in the range of about pH 5 to about pH 6 and most preferably at about pH 5.4 to about pH 5.9.

Polyaspartic acid at a relatively low concentration of about 25 ppm was found to inhibit the carbon dioxide rate corrosion of mild steel under substantially mild dynamic flow use conditions over a temperature range of about ambient room temperature to greater than about 80° C. For example, at about 50° C., polyaspartic acid having a weight average molecular weight of about 5,000 (PA-5) reduced the corrosion rate from about 104 mpy to about 27 mpy in about 1 hour which represents a reduction of greater than about 70%. At ambient room temperature, PA-5 reduced the corrosion rate from about 27 mpy to about 15 mpy in about 1 hour which represents a reduction of greater than about 40%.

Corrosion rate is generally defined as the corrosion effect on a metal per unit of time. The type of unit used to express corrosion rate depends on the technical system and on the type of corrosion effect. Thus, corrosion rate may be expressed in variable units. A description of the relationship among units commonly used for corrosion rates can be found in the literature. See, for example, David, (Ed), *ASM Materials Engineering Dictionary,* published by The Materials Information Society. Here, corrosion rate is expressed as an increase in corrosion depth per unit of time as mils per year (mpy) penetration rate.

FIGS. 1 through 11 and the following examples illustrate the effectiveness of polyaspartic acid having a weight average molecular weight of about 1,000, of about 2,000 and of about 4,400, which, respectively, are referred to as PA-1, PA-2, and PA-5 as a carbon dioxide corrosion inhibitor of mild steel. For convenience and not by limitation, 25 ppm of polyaspartic acid, regardless of Mw, was utilized and in all tests was added to artificial brine test solution at a use temperature of about 50° C. with pressure at about 1 bar carbon dioxide, unless indicated otherwise. For convenience, carbon dioxide corrosion rate inhibition will be referred to simply as corrosion rate inhibition and references to artificial brine or brine should be understood to be artificial brine substantially free of dissolved oxygen.

EXAMPLE 1

This example illustrates the carbon dioxide corrosion inhibiting properties of polyaspartic acid at three different weight average molecular weights of about 1000 (PA-1), about 2000 (PA-2) and about 4,400 (PA-5) on mild (1018) steel in artificial brine at a temperature of about 50° C. The effectiveness of corrosion inhibition was compared to that of a proprietary commercial corrosion inhibitor. Stock solutions of each inhibitor were utilized. The corrosion inhibitor was introduced to the brine solution at a concentration of about 25 ppm at a volume to volume basis (V/V). The appropriate amount of stock solution of polyaspartic acid (as received) was introduced to the test equipment using a microliter syringe.

Corrosion inhibition was measured using a bubble test and a (2 element) mild steel electrode (Corrater LPR probe). The results of the test simulate the carbon dioxide corrosion inhibition of the mild steel under mild dynamic flow use conditions.

The corrosion rate expressed in mils per year (mpy) is shown in the following Table II, and is graphically compared in FIG. 1 for untreated mild steel and for mild steel in the presence of the inhibitors over a period of about 12 hours.

TABLE II

| CARBON DIOXIDE CORROSION RATE (MPY) AT ABOUT 50° C. | | | | | |
|---|---|---|---|---|---|
| Time in | INHIBITOR | | | | |
| Hours | None | PA-5 | PA-2 | PA-1 | Commercial |
| 0 | 105 | 105 | 105 | 105 | 110 |
| 1 | 110 | 22 | 22 | 22 | 2 |
| 6 | 110 | 18 | 16 | 15 | 2 |
| 12 | 110 | 16 | 4 | 4 | 2 |

As shown by the results, the corrosion rates for mild steel in ionic strength brine solution at about 50° C. was typically greater than 100 mpy. The commercial corrosion inhibitor reduced the corrosion rate by about 98% in about 1 hour, and this reduction remained substantially constant up to about 12 hours. The polyaspartic acids, regardless of Mw, reduced the corrosion rate by about 78% in about 1 hour and continued to gradually further reduce the corrosion rate with time. Specifically, the PA-5 reduced the corrosion rate by about 83% in about 6 hours, by about 85% in about 12 hours and gradually continued to effect further corrosion rate reduction up to 24 hours. Likewise, the polyaspartic acids PA-2 and PA-1, each reduced the corrosion rate by about 85% in about 6 hours and by about 96% in about 12 hours, also gradually continuing further corrosion rate reduction up to a period of about 24 hours at which time the test was terminated.

EXAMPLE 2

The carbon dioxide corrosion rate inhibition of mild steel by 25 ppm PA-5 in artificial brine at about 50° C. use conditions was examined over a range of from about pH 4 to less than about pH 7. For this test, a series of artificial brine solutions were prepared having the pH adjusted to about pH 4, about pH 5.1 about pH 5.4 about pH 5.9 about pH 6.3 and about pH 6.6 by addition of $NaHCO_3$. The corrosion rate inhibition of PA-5 in each solution was then determined using the bubble test described in Example 1.

Figure 2:
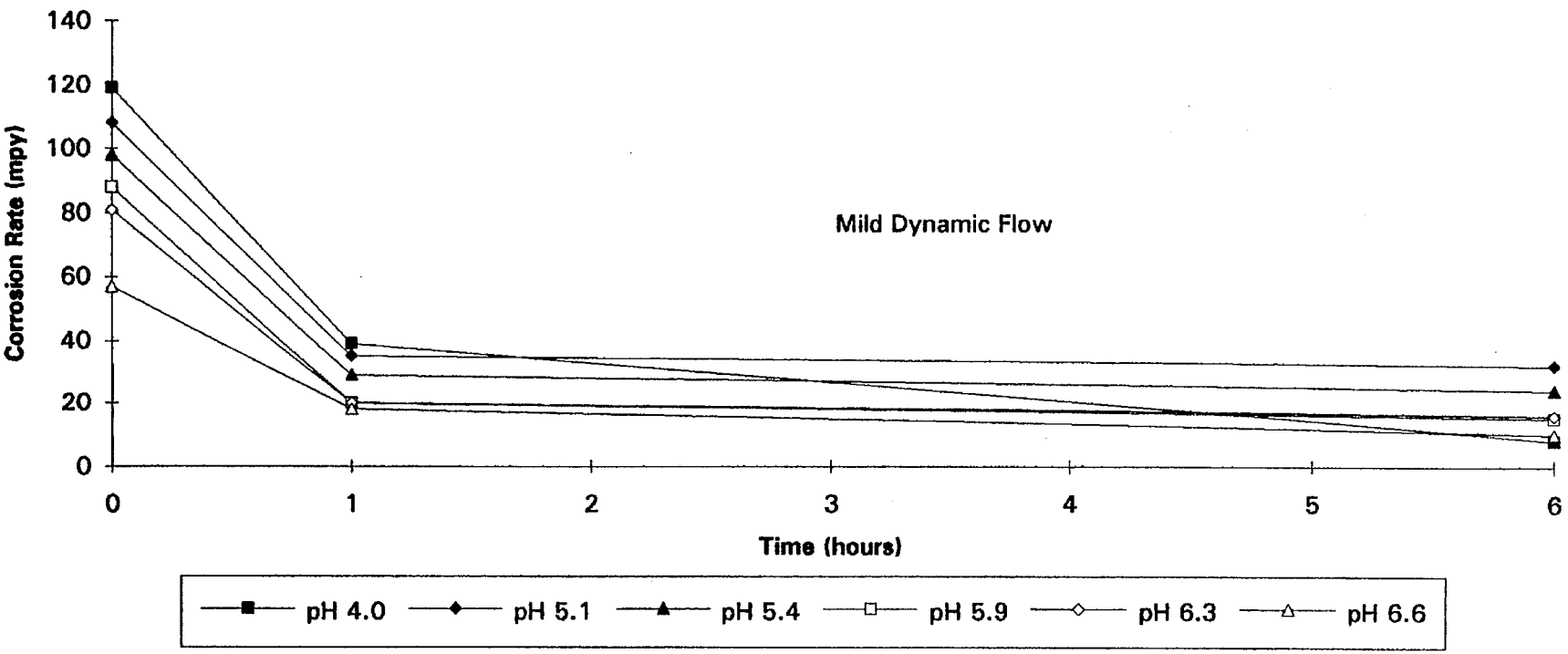
FIG. 2 graphically compares the effectiveness of carbon dioxide corrosion inhibition by polyaspartic acid ranging in weight average molecular weight from about 1000 to about 5000 plotted as a function of pH and time under simulated mild dynamic flow use conditions.
Figure 3:
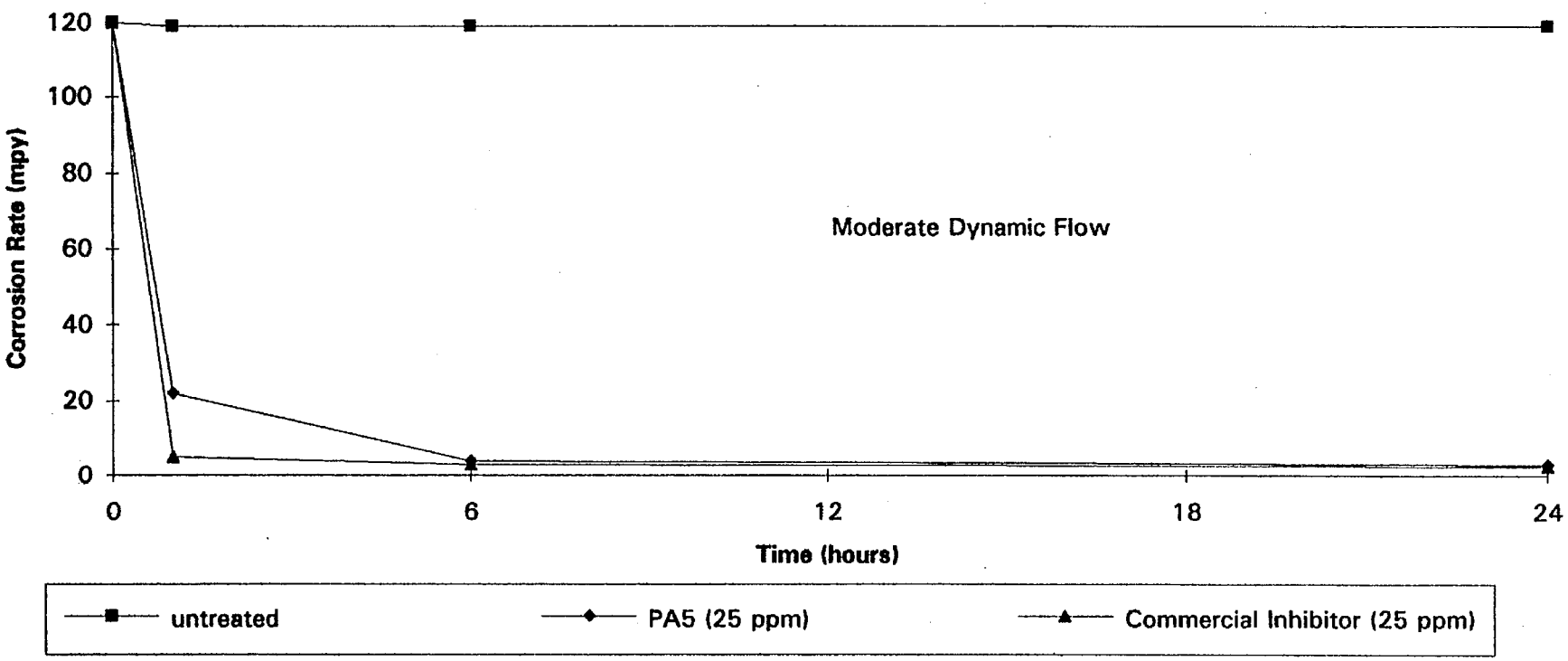
FIG. 3 graphically compares the effectiveness of carbon dioxide corrosion inhibition by polyaspartic acid ranging in weight average molecular weight from about 1000 to about 5000 relative to that of a reference commercial inhibitor plotted as a function of time under simulated moderate shear dynamic flow use conditions.

The corrosion rate mpy results of the bubble test are shown in the following Table III; and are graphically compared in FIG. 2 over a period of about 6 hours.

TABLE III

| | CORROSION RATE (MPY) | | | | | |
|---|---|---|---|---|---|---|
| Time in | INHIBITION AT | | | | | |
| Hours | pH 4 | pH 5.1 | pH 5.4 | pH 5.9 | pH 6.3 | pH 6.6 |
| 0 | 118 | 107 | 96 | 82 | 88 | 55 |
| 1 | 38 | 34 | 29 | 20 | 20 | 17 |
| 6 | 8 | 31 | 24 | 10 | 15 | 16 |

As shown by the results, at about pH 4 the initials corrosion rate of about 118 mpy was reduced by about 68% in about one hour and by about 93% in about 6 hours. At about pH 6.9, the initial corrosion rate of about 82 mpy was reduced by about 76% in about 1 hour and by about 88% in about 6 hours. At about pH 6.6, the initial corrosion rate of about 55 mpy was reduced by about 69% in one hour and by about 71% in about 6 hours.

EXAMPLE 3

The effectiveness of carbon dioxide corrosion inhibition in artificial brine at about 50° C. by PA-5 was determined and compared to that of a proprietary inhibitor each at 25 ppm concentrations utilizing the 3 liter recirculating flow loop apparatus to simulate substantially moderate dynamic flow use conditions. Corrosion rate measurements were made on mild steel with a standard 2 element linear polymerization resistance (LPR) corrosion probe. A flow velocity of about 1.6 meters per second (m/s) resulted in better simulating a desired liquid shear stress of about 7 Pa at the tube wall which is typically found in commercial pipelines.

The corrosion rate mpy results of this test over a period of about 24 hours are shown in the following Table IV, and are graphically compared in FIG. 4.

TABLE IV

| | CORROSION RATE (MPY) | | |
|---|---|---|---|
| Time in | INHIBITOR | | |
| Hours | None | PA-5 | Commercial |
| 0 | 120 | 120 | 120 |
| 1 | 120 | 22 | 5 |
| 6 | 120 | 3 | 2 |
| 24 | 120 | 3 | 2 |

As shown by the results, the baseline corrosion rates in the artificial brine solution over a period of about 24 hours were in the range of about 120 mpy to about 150 mpy for the untreated mild steel. The reference commercial corrosion inhibitor reduced the corrosion rate by about 96% in about one hour and by about 98% in about 6 hours, remaining at that level up to about 24 hours. Polyaspartic acid, PA-5, reduced the corrosion rate by about 82% in about 1 hour and by about 98% in about 6 hours maintaining that rate of corrosion up to about 24 hours. Thus, substantially the same level of corrosion rate inhibition as that achieved with the commercial inhibitor was achieved by PA-5 over a period of about 6 hours. These findings show that polyaspartic acid approaches the effectiveness of commercial inhibitor in reducing corrosion rate from carbon dioxide of mild steel in brine under substantially moderate dynamic flow use conditions.

EXAMPLE 4

The effective carbon dioxide corrosion inhibition each of polyaspartic acids, PA-1, PA-2 and PA-5 was compared against that of (1) a commercial polyaspartic acid having a Mw of about 5000 (Sigma Chemical); (2) a proprietary commercial inhibitor (3) a polypeptide composition of about 40% aspartic acid and about 60% asparagine; (4) a polypeptide composition of about 60% aspartic acid and about 40% asparagine; (5) a polypeptide composition of about 80% aspartic about 20% valine and (6) a polytyrosine. Each of the inhibitors were examined in a bubble test present at about 25 ppm in artificial brine.

A bubble test cell having a volume capacity of about 140 cubic centimeters was used to determine corrosion rate inhibition at a temperature of about 50° C. over a period of about 14 hours. The artificial brine had a pH of about 5.6 and each of the inhibitors were separately introduced to the test cell by transferring the appropriate amount of stock solution (as received) on a volume (v/v) basis to the equipment using a microliter syringe. The test was conducted under one bar carbon dioxide pressure.

Figure 4:
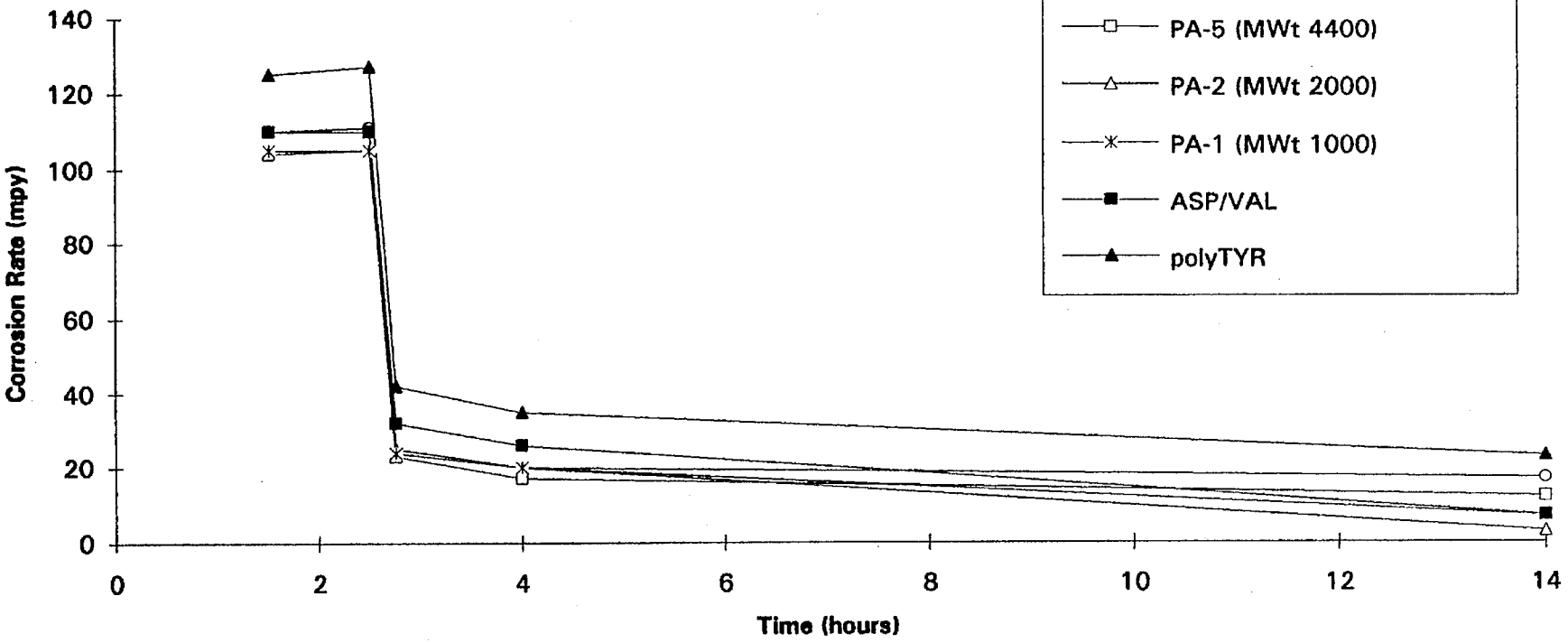
FIGS. 4 and 5 graphically compare the effectiveness of carbon dioxide corrosion inhibition by polyaspartic acid ranging in weight average molecular weight from about 1000 to about 5000 relative to combination type inhibitors and commercial inhibitors plotted as a function of time under simulated mild dynamic flow use conditions.
Figure 5:
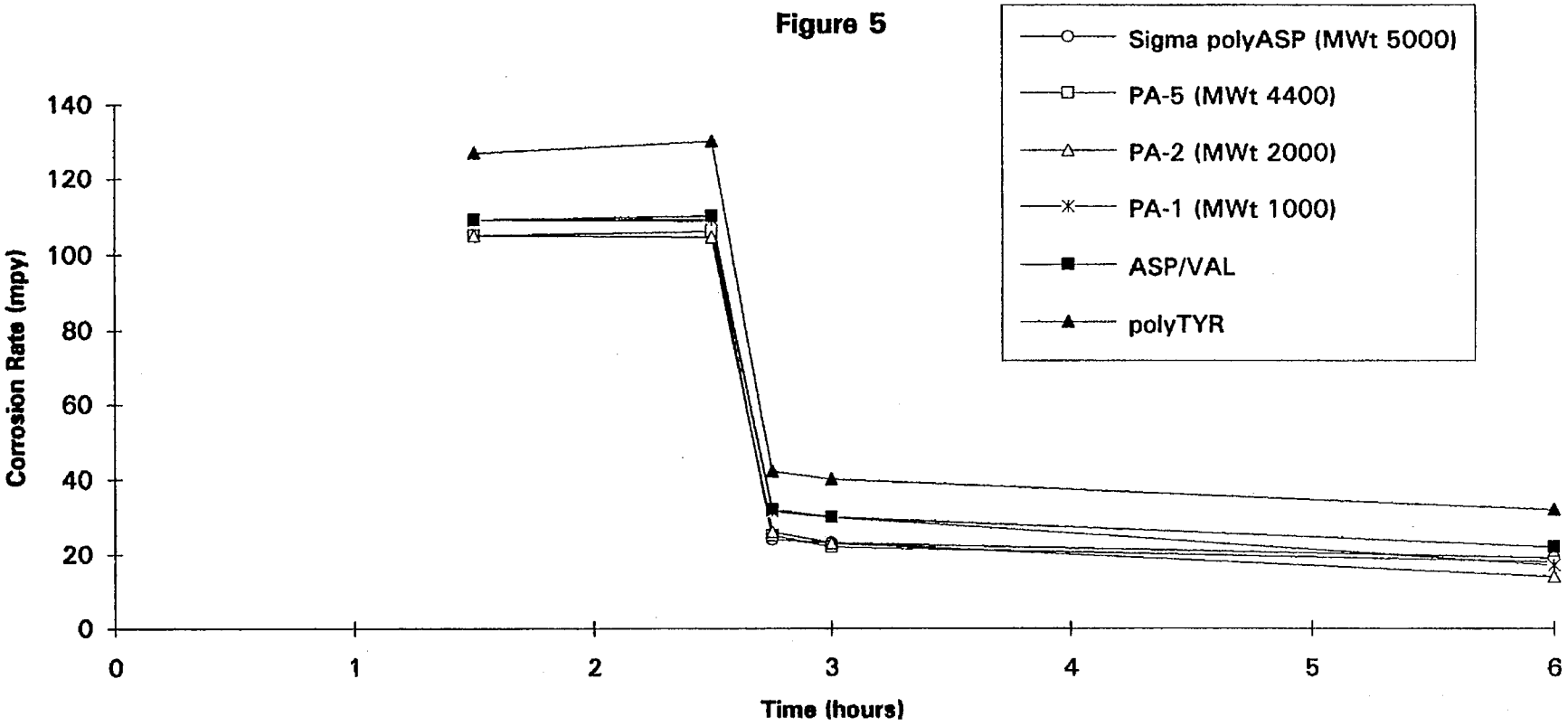

The corrosion rate mpy inhibition data are graphically compared shown in FIGS. 4 and 5.

The data show that polyaspartic acids regardless of Mw had a performance efficiency in corrosion rate reduction of about 70% to about 85% after about 6 hours compared to a reduction of about 98% for the proprietary commercial inhibitor. Moreover, the polyaspartic acids, regardless of Mw were more effective during this 6-hour period than were the four polypeptide composition inhibitors (Nos. 3–6). The polypeptide composition inhibitors (Nos. 3–6) appeared to improve after about 10 to about 12 hours, but this improvement was not found to be reproducible. However, there is some suggestion that surface films may have some formed over a period of time which may have value for batch inhibition treatments.

EXAMPLE 5

The general procedure of the bubble test described in Example 4 was followed except that the inhibitors were PA-1, PA-2 and poly-L-histidine (polyHIS) and in each case the inhibitors were examined at a pH of about 5.1 and at about 5.6. The natural pH of the artificial brine was about 5.6. For the test at about pH 5.1, the artificial brine pH was adjusted with $NaHCO_3$.

Figure 6:
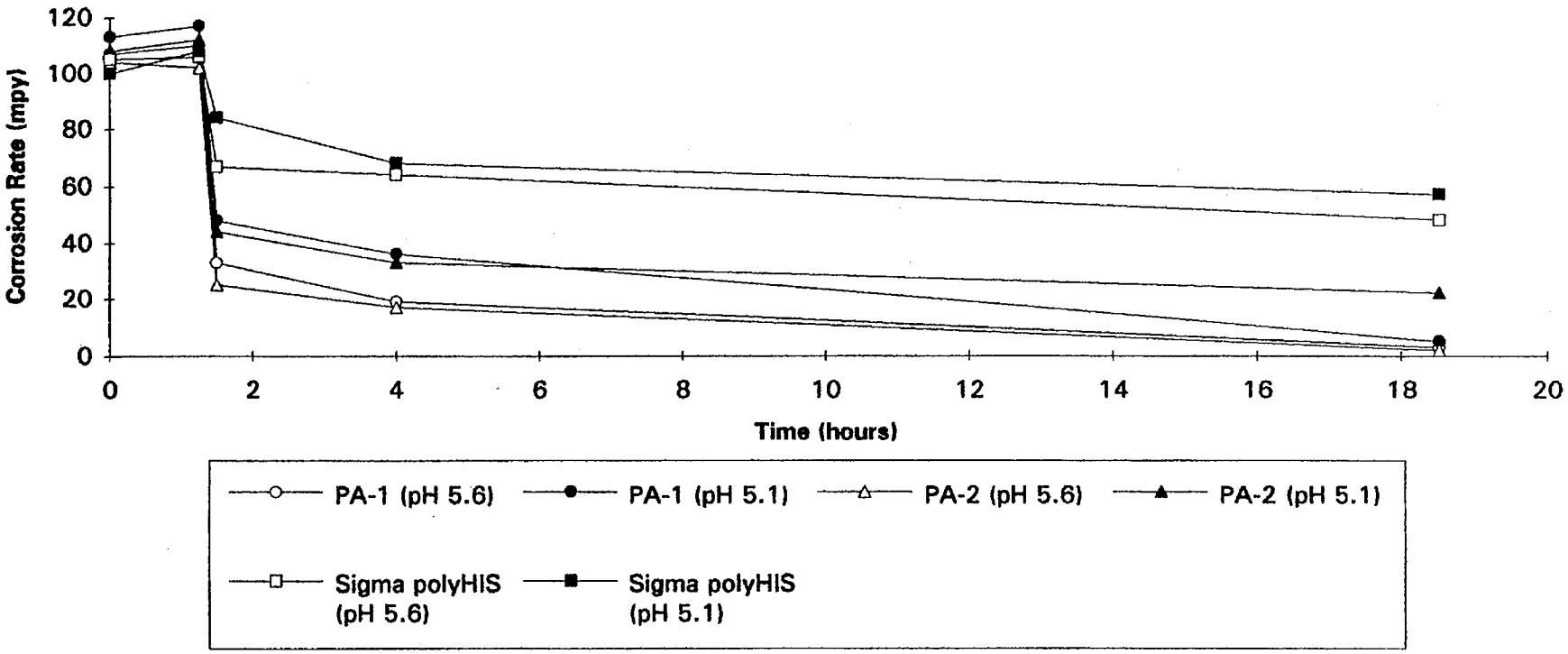
FIG. 6 graphically compares the effectiveness of carbon dioxide corrosion inhibition by polyaspartic acid ranging in weight average molecular weight from about 1000 to about 2000 relative to that of (polyHIS) plotted as a function of pH and time under simulated mild dynamic flow use conditions.

The corrosion rate (mpy) results of the bubble test are graphically compared in FIG. 6 plotted as a function of time over a period of about 18 hours. The data results indicate that reducing the pH of the brine below about pH 5.6 tends to reduce the effectiveness of the corrosion rate inhibition of PA-1 and PA-2. However, both of the polyaspartic acids, were each substantially more effective in reducing the corrosion rate than was the polyhistidine.

EXAMPLE 6

This examples illustrates the effect of calcium ion present in artificial brine on the corrosion rate inhibition of polyaspartic acid, PA-1. The procedure of the bubble test described in Example 4 was followed, except that the artificial brine was prepared containing zero ppm, about 1000 ppm and about 10,000 ppm of calcium ion ($Ca^{++}$). The carbon dioxide corrosion rate inhibition by 25 ppm of PA-1 was determined at a pH of about 5.6 over a period of about 8 hours. Duplicate determinations were made.

Figure 7:
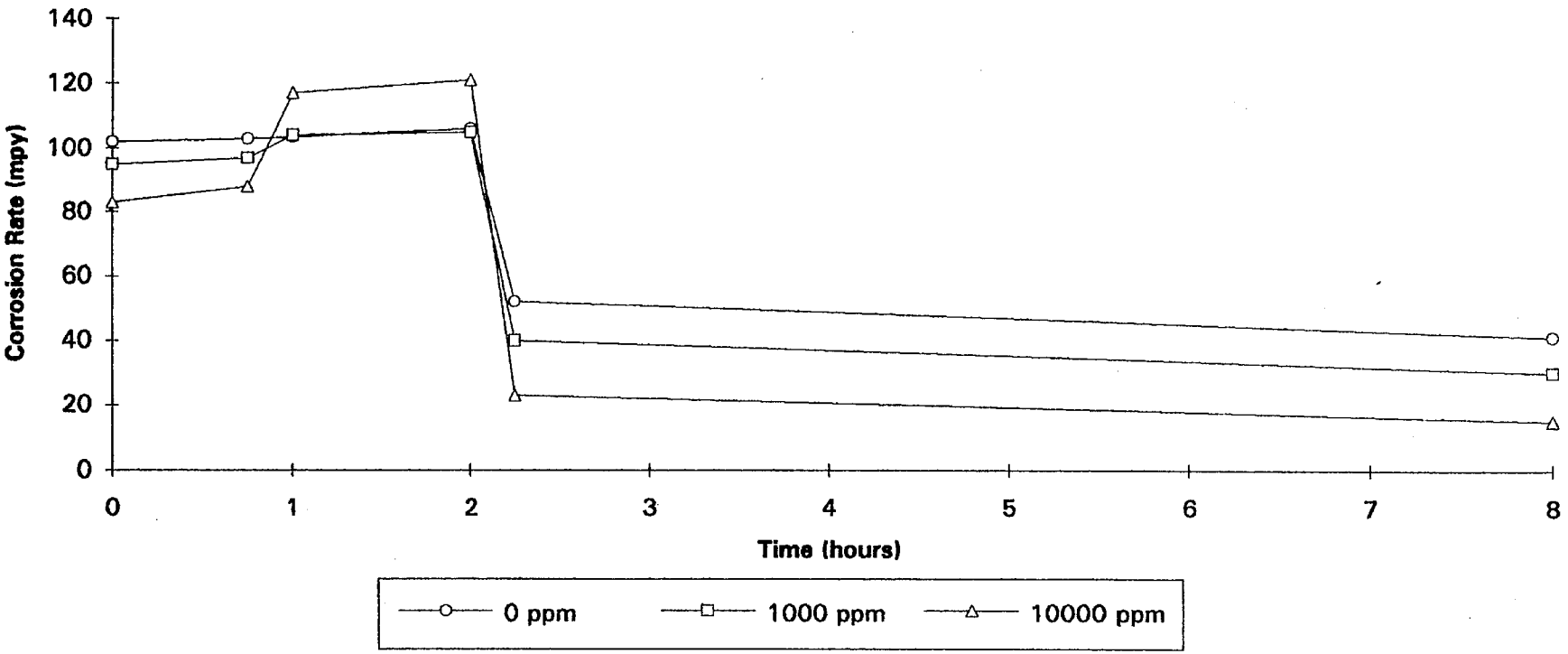
FIG. 7 graphically depicts the effectiveness of carbon dioxide corrosion inhibition by polyaspartic acid having a weight average molecular weight of about 1000 in brine varying in calcium ion content at a pH of about 5.6 under simulated mild dynamic flow use conditions.

The corrosion rate mpy result is graphically depicted in FIG. 7 plotted as a function time. The data show the effectiveness of the corrosion rate inhibition by PA-1 beneficially increased as the bulk calcium content ion in the brine increased.

Figure 8:
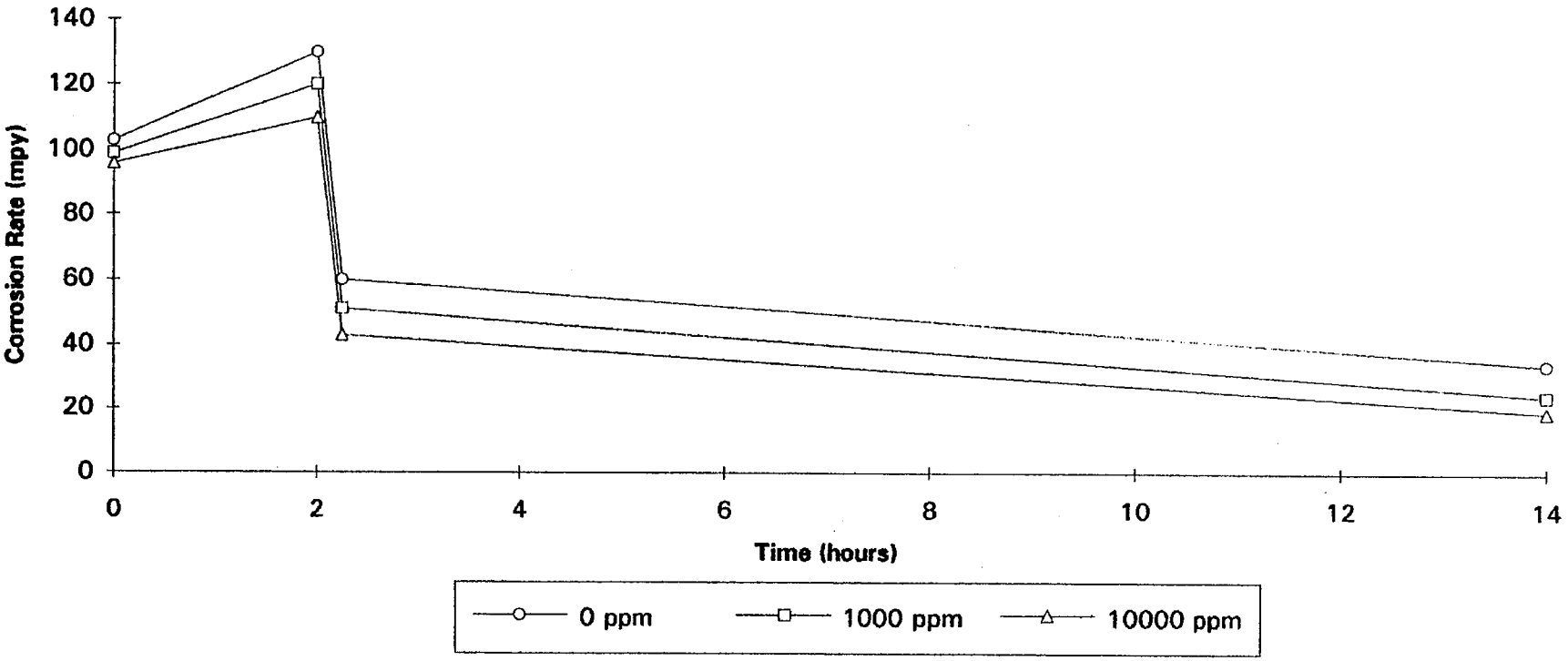
FIG. 8 graphically depicts the effectiveness of carbon dioxide corrosion inhibition by polyaspartic acid having a weight average molecular weight of about 1000 in brine varying in calcium ion content at a pH of about 4.5 under simulated mild dynamic flow use conditions.

The bubble test was then repeated, except that the pH of the artificial brine was decreased to about pH 4.5 by adding $NaHCO_3$, and the corrosion inhibition rate determined over a period of about 14 hours. The corrosion rate mpy results of duplicate tests are graphically shown in FIG. 8 plotted as a function of time. These data indicate that the beneficial inhibition of PA-1 in the presence of calcium ion became less apparent at the lower pH than it was at the higher pH shown in FIG. 7. It is believed that this decrease is because fewer aspartate groups are ionized below the known $pK_a$ value of about 4.7 for polyaspartic acid.

A third test was similarly carried out, except that calcium-free brine (0 ppm $Ca^{++}$) and normal brine (containing about 2800 ppm $Ca^{++}$ was utilized. Calcium polyaspartate salt (25 ppm, calculated as polyaspartic acid) was utilized as the inhibitor.

Figure 9:
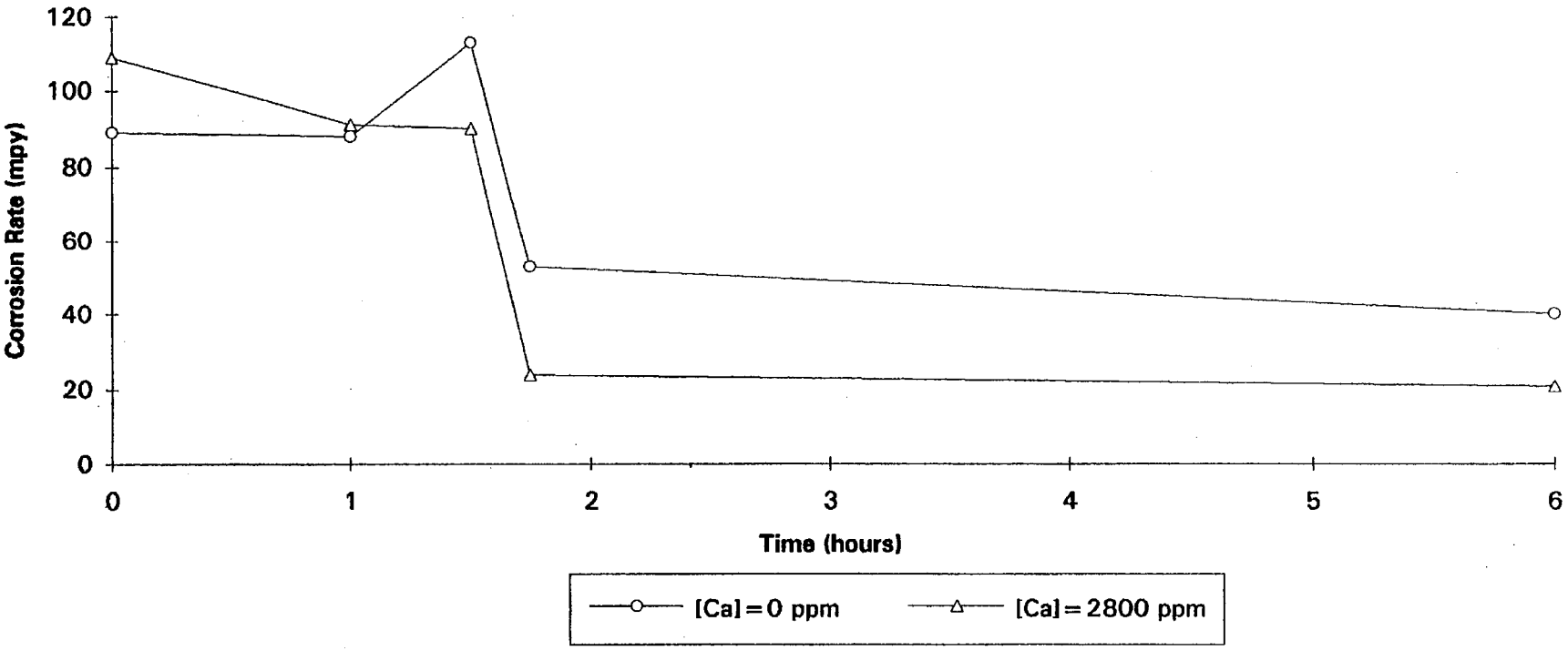
FIG. 9 graphically depicts the effectiveness of carbon dioxide corrosion inhibition by calcium aspartate in calcium-free brine and brine containing 2800 ppm calcium ion plotted as a function of time under simulated mild dynamic flow use conditions.
Figure 10:
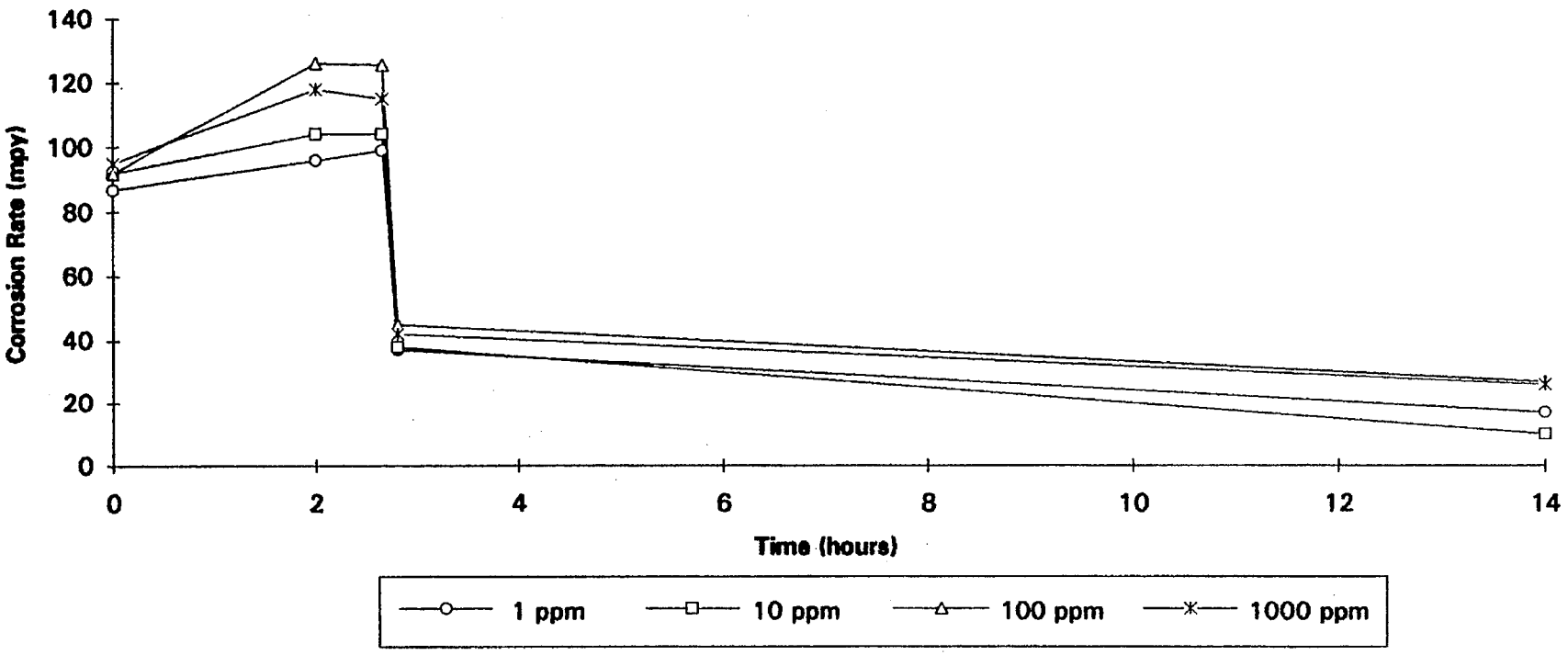
FIG. 10 graphically depicts the effectiveness of carbon dioxide corrosion inhibition by polyaspartic acid having a weight average molecular weight of about 1000 in brine containing from about 1 ppm to about 1000 ppm ferrous ion plotted as a function of time under simulated mild dynamic flow use conditions.

The corrosion rate mpy data results are graphically compared in FIG. 9 plotted as a function of time over a period of about 6 hours. This data illustrate that calcium polyaspartate was less efficient as a carbon dioxide corrosion inhibitor in calcium-free brine than in calcium-containing brine.

EXAMPLE 7

This example illustrates the effect of ferrous ion ($Fe^{++}$) on the carbon dioxide corrosion inhibition of polyaspartic acid, PA-1, in artificial brine. The bubble test described in Example 4 was followed, except that the artificial brines were prepared containing about 1 ppm, about 10 ppm, about 100 ppm and about 1000 ppm of ferrous ion introduced as $FeSO_4$. The corrosion rate (mpy) was determined using 25 ppm of PA-1. The results of the corrosion rate mpy over a period of about 14 hours are graphically shown in FIG. 10.

The data show that the effectiveness of polyaspartic acid, PA-1, as a carbon dioxide corrosion inhibitor was substantially unaffected by the amount of ferrous ion present in the brine.

EXAMPLE 8

The corrosion rate inhibition by polyaspartic acid, PA-5, on mild steel under substantially moderate dynamic flow use conditions was determined in three separate runs using the three liter recirculating flow loop described in Example 3 with a flow rate of about 1.6 meters per second (m/s) at a temperature of about 50° C. over a period of about ten hours.

Figure 11:
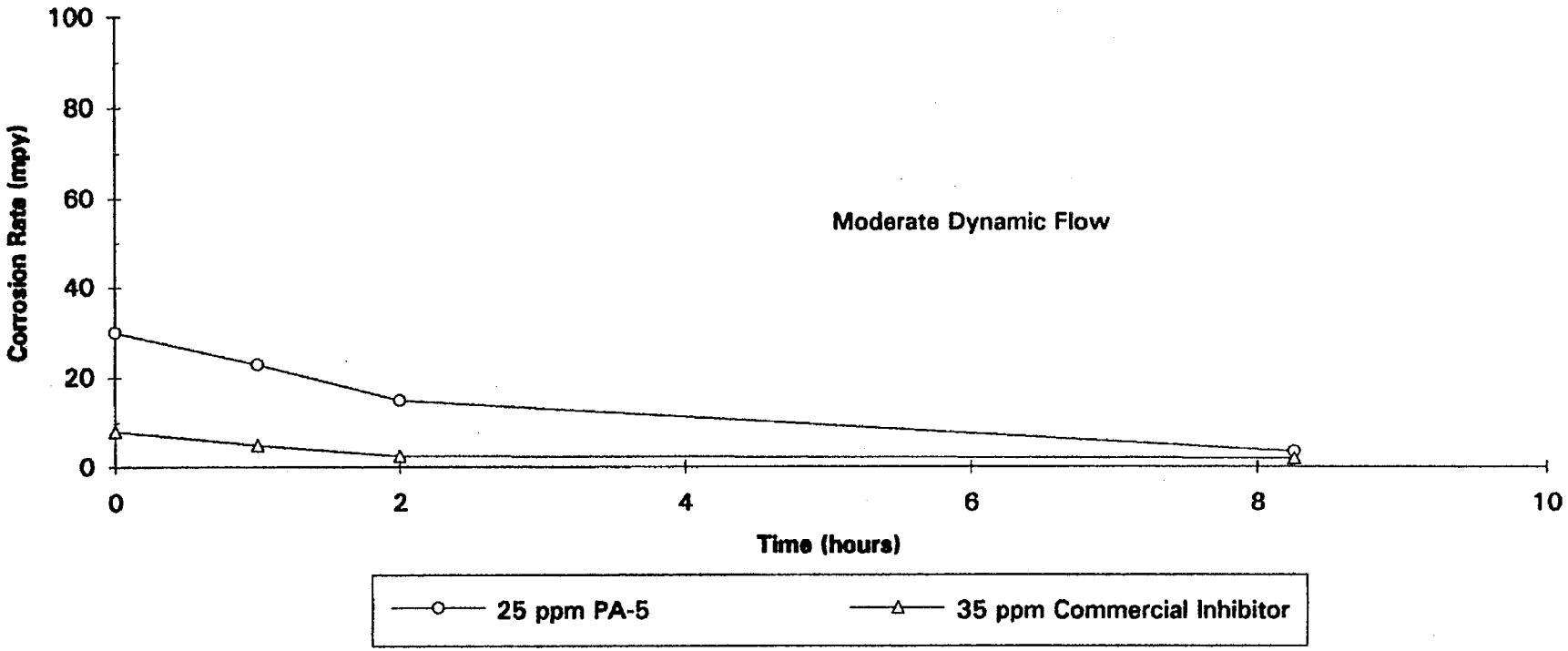
FIG. 11 graphically depicts the effectiveness of carbon dioxide corrosion inhibition by polyaspartic acid having a weight average molecular weight of about 4400 relative to that of commercial inhibitor plotted as a function of time under simulated moderate dynamic flow conditions.

The data obtained for the corrosion rate (mpy) are graphically depicted in FIG. 11 compared to that achieved with a proprietary commercial inhibitor, present at a concentration of about 35 ppm, the amount commonly used in the field.

The data show that the effective corrosion and inhibition performance of PA-5 was substantially equivalent to that of the proprietary commercial inhibitor after a period of about 3 hours.

EXAMPLE 9

In this example, the effective carbon dioxide corrosion inhibition of polyaspartic acid, PA-1 was determined in artificial brine at about 50° C. with a pressure at one bar carbon dioxide. The bubble test described in Example 1 was followed except that the brine was prepared with amounts of sodium bicarbonate varying from none to about 10,000 ppm to provide artificial brine having a pH ranging from about pH 4 to about pH 6.6.

The test was performed over a period of about 11 hours as follows.

Six test cells were prepared. Each test cell contained artificial brine having a sodium bicarbonate ($NaHCO_3$) content in ppm of either (a) zero (b) 125; (c) 375; (d) 1250; (e) 3750 or (f) 10,000 to provide artificial brine having a pH, respectively, of about pH 4.0; about pH 5.1; about pH 5.4; about pH 5.9; about pH 6.3 and about pH 6.6.

A baseline before addition of $NaNCO_3$ corrosion rate (mpy) (Sequence A) was first determined after a total elapsed time of about 0.5 hours and about 1.5 hours. After a total elapsed time of about 2 hours (Sequence B), sodium bicarbonate was then added in the amounts listed in the following Table V. The corrosion rate was again determined after a total elapsed time of about 2.5 hours and about 3.5 hours. After a total elapsed time of about 4 hours, 25 ppm of PA-1 was added to each of the test cells (Sequence C). The corrosion rate was again determined after a total elapsed time of about 5 hours, about 7 hours, about 9 hours and about 11 hours.

The corrosion rate (mpy) determined is shown in the following Table V.

TABLE V

| Elapsed Time | CORROSION RATE (MPY) | | | | | |
|---|---|---|---|---|---|---|
| | $NaHCO_3$ in ppm in Brine | | | | | |
| (Hrs.) | 0 | 125 | 375 | 1250 | 3750 | 10000 |
| | A. Base Line Corrosion Rate | | | | | |
| 0.5 | 117 | 117 | 122 | 118 | 124 | 103 |
| 1.5 | 110 | 111 | 111 | 107 | 110 | 103 |
| 2.0 | B. $NaHCO_3$ added to each cell | | | | | |
| 2.5 | 112 | 100 | 93 | 85 | 95 | 97 |
| 3.5 | 118 | 107 | 96 | 82 | 88 | 55 |
| 4.0 | C. 22 ppm PA-1 added to each cell | | | | | |
| 5.0 | 38 | 34 | 27 | 20 | 20 | 17 |
| 7.0 | 18 | 32 | 27 | 17 | 18 | 17 |
| 9.0 | 10 | 33 | 25 | 13 | 16 | 16 |
| 11.0 | 8 | 31 | 24 | 10 | 15 | 16 |

The data indicate that as the pH of the artificial brine increases, it tends to reduce the initial baseline corrosion rate. The corrosion inhibition efficiency of the polyaspartic acid, PA-1, appears to reduce the corrosion rate and appears to peak at about an 80% corrosion rate reduction at a pH of about pH 5.4 to about pH 5.9. This pH value is substantially in the range of the natural pH environment of brine actually found in the Forties oilfield.

The present invention has been described with respect to preferred embodiments but are not limited thereto. It would be apparent to one skilled in the art that the foregoing method illustrations are subject to numerous modifications which do not depart from the spirit and scope of this invention.

What is claimed is:

1. A method of inhibiting carbon dioxide corrosion of ferrous metals in the presence of an aqueous saline environment containing dissolved carbon dioxide and having a substantially acidic pH which comprises adding to the saline environment a corrosion inhibiting amount of polyaspartic acid having a weight average molecular weight in the range of about 1,000 to about 10,000 and wherein more than 50% of the polyaspartic acid is in β-form.

2. The method of claim 1, wherein the aqueous saline environment is brine substantially free of dissolved oxygen.

3. The method of claim 1, wherein the pH is in the range of about 4 to about 6.6.

4. The method of claim 1, wherein the amount of polyaspartic acid present is at least about 10 parts per million based on the volume of aqueous saline in contact with the ferrous metals.

5. The method of claim 4 wherein the polyaspartic acid is present at a concentration of about 25 parts per million.

6. The method of claim 1, wherein the polyaspartic acid is in a salt form and having a counterion selected from the group consisting of an alkali metal, an alkaline earth metal, ammonium and a quaternary alkyl ammonium group having 1 to about 4 carbon atoms in each alkyl moiety thereof.

7. The method of claim 1, wherein the polyaspartic acid has a weight average molecular weight of about 1,000 to about 5,000.

* * * * *